United States Patent [19]

Rushing

[11] Patent Number: 5,065,199

[45] Date of Patent: Nov. 12, 1991

[54] OBTAINING COLOR BALANCE FOR OPTICAL COPIERS BY SETTING THE EXPOSURE AND PRIMARY VOLTAGE FOR EACH COLOR

[75] Inventor: Allen J. Rushing, Webster, N.Y.

[73] Assignee: Eastman Kodak Company, Rochester, N.Y.

[21] Appl. No.: 604,267

[22] Filed: Oct. 29, 1990

[51] Int. Cl.[5] ..... G03G 15/01

[52] U.S. Cl. ..... 355/326; 355/219; 355/228; 355/239; 355/327

[58] Field of Search ..... 355/208, 239, 326, 327, 355/232, 219, 220, 328, 200, 228

[56] References Cited

U.S. PATENT DOCUMENTS 4,063,810 12/1977 Mailloux ..... 355/239
4,106,870 8/1978 Kondo et al. ..... 355/327
4,825,252 4/1989 Suzuki et al. ..... 355/32
4,937,616 6/1990 Maeda et al. ..... 355/326 X

*Primary Examiner*—Joan H. Pendegrass
*Assistant Examiner*—Christopher Horgan
*Attorney, Agent, or Firm*—Milton S. Sales

[57] ABSTRACT

An electrostatographic color copier includes a photoconductor imaging member, means for variably charging the imaging member, and means for imagewise projection exposing the charged photoconductor imaging member with a series of color separation light images such that the focal plane of the projection images changes from one color separation to another to cause an out-of-focus condition at the photoconductor imaging member, the intensity of the exposure being adjustable. Controller means are provided for adjusting either the charge placed on the photoconductor imaging member or the exposure intensity from one color separation to another to compensate for differences in focus between the color separations.

9 Claims, 2 Drawing Sheets

OBTAINING COLOR BALANCE FOR OPTICAL COPIERS BY SETTING THE EXPOSURE AND PRIMARY VOLTAGE FOR EACH COLOR

CROSS REFERENCE TO COPENDING APPLICATIONS

Reference is made to commonly assigned, co-pending U.S. Patent application Ser. No. 366,396 filed in the name of C.J. Baxter on June 15, 1989.

BACKGROUND OF THE INVENTION

1. Technical Field

This invention relates generally to optical electrophotographic color copiers.

2. Background Art

Color copiers which make multiple projection exposures onto separate color separation image frames of a charged photoconductor are known. It is generally understood that the focal plane will change from one color separation to another, due in part to the different wave lengths of exposure light and further in part to optical characteristics of the filter elements (red, green, and blue, for example) used to create the different color exposures. If uncompensated for, these shifts in the focal plane between color separations will cause an out-of-focus condition at the photoconductor surface for one or more of the color exposures.

An out-of-focus condition in one color separation may decrease the exposure of very fine detail to the extent that color balance is affected. This is generally not a problem when copying reflection original documents because most documents being copied are made up of coarser images in which color balance is substantially unaffected by out-of-focus conditions.

However, the problem is aggravated in copiers adapted to reproduce images from photographic transparencies, which are often projected onto the photoconductor surface through a halftone screen to enhance tone scale. The screens themselves create the very fine dot pattern detail, even in the solid areas of the image. Breaking the image into a fine dot pattern causes color shift problems when one color separation is exposed more out-of-focus than another color separation. Since the dot pattern covers the entire image, color shifts are quite noticeable.

Of course, one solution would be to employ better optics which would focus all colors uniformly. However, such optics is costly, and would require extensive hardware changes to copiers already

DISCLOSURE OF INVENTION

It is an object of the present invention to compensate for the focal plane differences between one color separation and another by adjusting the primary charge on the photoconductor differently from settings used for reflection document copying.

It is another object of the present invention to compensate for the focal plane differences between one color separation and another by adjusting the exposure.

In accordance with these and other objects, an electrostatographic color copier includes a photoconductor imaging member, means for variably charging the imaging member, and means for imagewise projection exposing the charged photoconductor imaging member with a series of color separation light images such that the focal plane of the projection images changes from one color separation to another to cause an out-of-focus condition at the photoconductor imaging member, the intensity of the exposure being adjustable. Controller means are provided for adjusting either the charge placed on the photoconductor imaging member or the exposure intensity from one color separation to another to compensate for differences in focus between the color separations.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made accompanying drawings, in which.

BEST MODE FOR CARRYING OUT THE INVENTION

Figure 1:
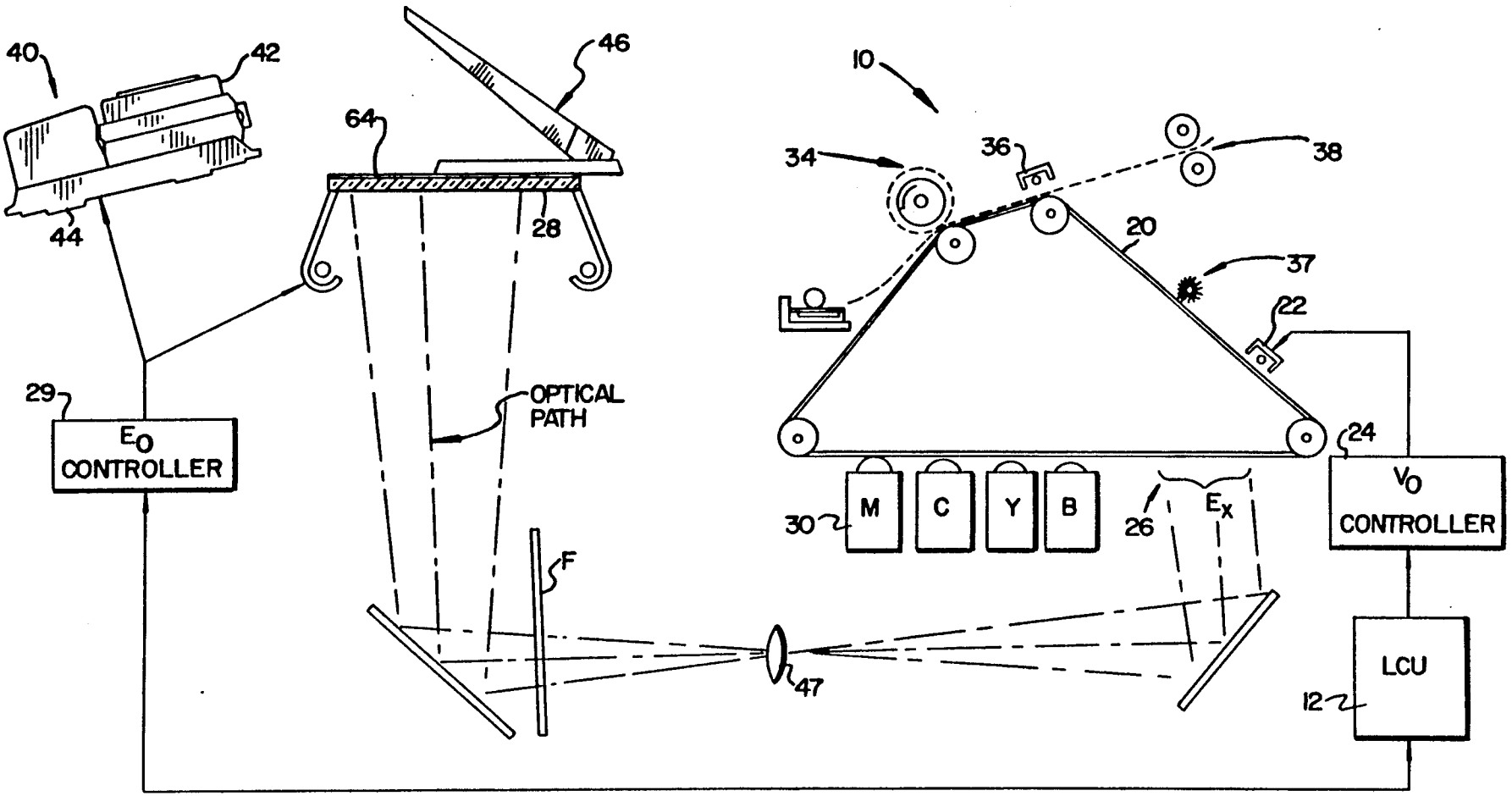
FIG. 1 is a generally schematic front elevational view, partly in cross-section, of a slide transparency projector and electrophotographic reproduction apparatus.
Figure 2:
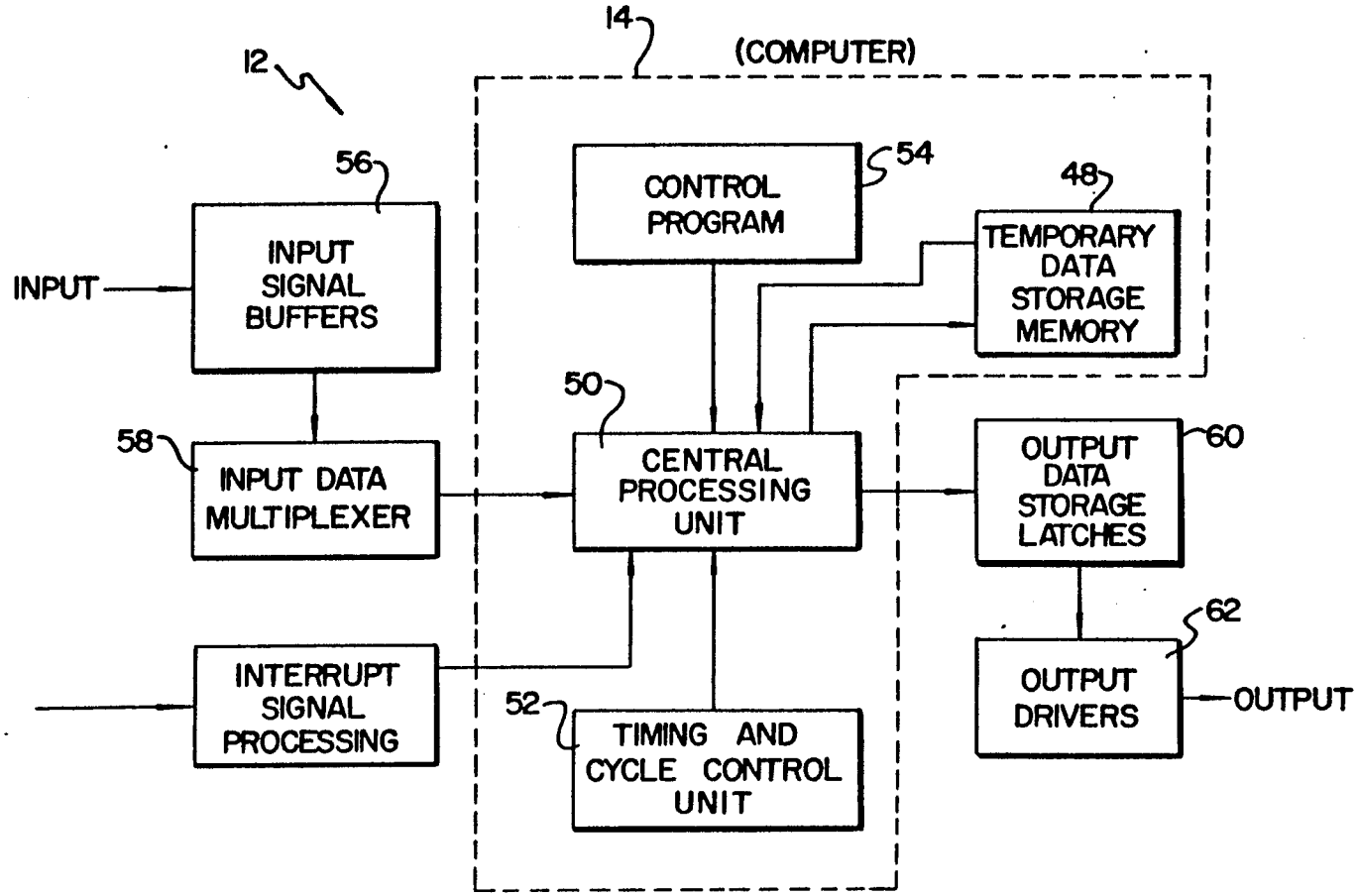
FIG. 2 is a block diagram of the logic and control unit shown in FIG. 1.

FIG. 1 schematically illustrates various stations of an optical exposure electrophotographic copier 10. Copier 10 includes a logic and control unit 12 having a programmable digital computer 14 (FIG. 2). Logic and control unit 12 actuates work stations in timed relation to movement of a photoconductor imaging member such as illustrated photconductive belt 20 past the stations.

For a complete description of the work stations, see commonly assigned U.S. Pat. No. 3,914,046. Briefly, a charging station 22 sensitizes belt 20 by applying a uniform electrostatic charge of predetermined primary voltage $V_0$ to the surface of the photoconductive belt. The output of the charger is regulated by a programmable controller 24, which is in turn controlled by logic and control unit 12 to adjust primary voltage $V_0$.

At an exposure station 26, optically projected light from an original document on platen 28 imagewise dissipates the electrostatic charge on the photoconductive belt to form a latent image of a document to be produced. Exposure is regulated by a programmable controller 29, which is in turn controlled by logic and control unit 12.

Travel of belt 20 brings the areas bearing the latent charge images into a development station 30. The development station has a magnetic brush for each color toner in juxtaposition to, but spaced from, the travel path of the belt. Magnetic brush development stations are well known. For example, see U.S. Pat. No. 4,473,029 to Fritz et al and U.S. Pat. No. 4,546,060 to Miskinis et al.

Logic and control unit 12 selectively activates the development station in relation to the passage of the image areas containing latent images to selectively bring the magnetic brush into engagement with the belt. The charged toner particles of the engaged magnetic brush are attracted to the oppositely charged latent imagewise pattern to develop the pattern.

A transfer station 34, a detack 36, and a cleaning station 37 complete the film loop. After transfer of the unfixed toner images to a receiver sheet at station 34, such sheet is separated from belt 20 at detack 34 and transported to a fuser station 38 where the image is fixed.

A projection apparatus 40 is provided for enabling copier 10 to reproduce transparencies such as 35 mm slides. A projector 42 is mounted on a support 44 which is attached to the housing of the copier adjacent to transparent platen 28. The projector, which is for example a modified Ektagraphic III slide projector manufactured by the Eastman Kodak Co. of Rochester, New York, projects a real image of a slide onto the platen. A mirror 46 intersects the optical path from the projector and is oriented at an angle from the horizontal so as to direct the optical path, from the projector, perpendicular to the platen. The real image projected onto the platen by projector 42 serves as the object for the main copier lens 47.

Projector 42 is electrically coupled to the copier to communicate with logic and control unit 12 to indicate that the projector apparatus is to be used as the source of information to be reproduced. Accordingly, when the projector is actuated to advance a slide transparency into the gate, a signal is sent to logic and control unit 12 to indicate that a copy run using the projector as the information input source can begin. After the operator sets the reproduction machine for the number of reproductions of each slide transparency to be made and initiates the reproduction process by pressing the start copy button, a signal is sent from logic and control unit 12 to fire a Xenon flash exposure lamp in synchronization with the operation of the electrostatographic process of copier 10. The amount of exposure is regulated by programmable controller 29, which is in turn controlled by logic and control unit 12.

When the requisite number of images of a slide transparency necessary to produce a desired number of multi-color reproductions has been formed, logic and control unit 12 sends a signal to projector 42 to index the projector to bring the next slide transparency into the gate. Additional details of the slide projector apparatus are disclosed in commonly assigned, co-pending U.S. Patent application Ser. No. 366,396 filed in the name of C.J. Baxter on June 15, 1989. The disclosure of that application is hereby incorporated into the specification.

Referring to FIG. 2, a block diagram of logic and control unit 12, which interfaces with the various electromechanical subsystems, is shown. The logic and control unit consists of temporary data storage memory 48, central processing unit 50, timing and cycle control unit 52 and a stored program control 54. Data input and output is performed sequentially under program control. Input data is either applied through input signal buffer 56 to a multiplexer 58 or through an interrupt signal processor.

The output data and control signals from computer 14 are applied to storage latches 60 which provide inputs to suitable output drivers 62 directly coupled to the leads for the work stations. More specifically, the output signals from the logic and control unit are logic level, digital signals which are buffered and amplified to provide drive signals to various clutches, brakes, solenoids, power switches and numeric displays in the various work stations. The logic and control unit processing functions can be programmed by changing the instructions stored in the computer memory.

In electrophotographic reproduction apparatus, it is desirable to reproduce continuous-tone information as half-tone images. See for example, U.S. Pat. No. 3,627,526, which issued to P.J. Donald on Dec. 14, 1971, and U.S. Pat. No. 4,740,818, which issued to Tsilibes et al. on Apr. 26, 1988. It is also desirable to reproduce slide transparencies with a screen to enhance reproductions made therefrom by creating a very fine dot pattern detail, even in the solid areas of the image. To accomplish this, a screen may be physically placed in the optical path between the transparancy and the photoconductor at a location where the image is substantially in focus. Such a position would be at the platen or at the photoconductor in the illustrated embodiment. Such a screen is shown at 64 in FIG. 1.

Since the focal plane changes from one color separation to another, as discussed above, there will result an out-of-focus condition at the photoconductor surface for one or more of the color exposures. Such an out-of-focus condition in one color separation may decrease the exposure of the very fine detail created by the screen to the extent that color balance is affected. Since the dot pattern covers the entire image, color shifts are quite noticeable.

By the present invention, logic and control unit 12 is programmed to adjust controller 24 between color separations from slide transparancy originals projected through half-tone screens. The adjustment takes into account the development characteristics of the different toners in the four-color development station 30. According to the present invention, an additional factor is incorporated in the adjustment determination when the exposure is to be made using projection apparatus 40. That factor, determined empirically or calculated, takes into account the loss of density in the developed color separation due to the out-of-focus condition of one color separation compared to the other color separations.

As discussed above, projector 42 communicates with logic and control unit 12 to indicate that the projector apparatus is to be used as the source of information to be reproduced. Central processing unit 50, under the control of software 54, refers to a look-up table in memory 48 to determine an adjustment in primary voltage $V_0$ and/or the exposure value to compensate for out-of-focus conditions associated with each color separation. These adjustments are used in commanding programmable controllers 24 and 29, respectively.

The invention has been described in detail with particular reference to preferred embodiments thereof, but it will be understood that variations and modifications can be effected within the spirit and scope of the invention.

What is claimed is:

1. An electrostatogrqaphic color copier comprising:

a photoconductor imaging member;

means for charging the photoconductor imaging member to a primary voltage;

means for imagewise projection exposing the charged photoconductor imaging member with a series of color separation light images wherein the focal plane of the projection images may change from one color separation to another to cause an out-of-focus condition at the photoconductor imaging member tending to adversely affect color balance; and controller means for compensating for differences in focus between the color separations by adjusting the primary voltage placed on the photoconductor imaging member from one color separation to another to improve color balance.

2. An electrostatographic color copier as set forth in claim 1 wherein said projection exposing means includes means for converting continuous tone images to half-tone images for exposure of the imaging member.

3. An electrostatographic color copier as set forth in claim 2 wherein said converting means comprises a half-tone screen through which the projected image passes at a point whereat the projected image is substantially in focus.

4. An electrostatographic color copier as set forth in claim 1 wherein said projection exposing means includes means for projecting photographic transparencies onto the imaging member through a half-tone screen.

5. An electrostatographic color copier comprising:

a photoconductor imaging member;

means for charging the photoconductor imaging member;

means for imagewise projection exposing the charged photoconductor imaging member with a series of color separation light images wherein the focal plane of the projection images may change from one color separation to another to cause an out-of-focus condition at the photoconductor imaging member tending to adversely affect color balance, the intensity of the exposure being adjustable; and controller means for compensating for differences in focus between the color separations by adjusting the exposure intensity from one color separation to another to to improve color balance.

6. An electrostatographic color copier as set forth in claim 5 wherein said projection exposing means includes means for converting continuous tone images to half-tone images for exposure of the imaging member.

7. An electrostatographic color copier as set forth in claim 6 wherein said converting means comprises a half-tone screen through which the projected image passes at a point whereat the projected image is substantially in focus.

8. An electrostatographic color copier as set forth in claim 5 wherein said projection exposing means includes means for projecting photographic transparencies onto the imaging member through a half-tone screen.

9. An electrostatographic color copier comprising:

a photoconductor imaging member;

means for charging the photoconductor imaging member to a primary voltage;

means for imagewise projection exposing the charged photoconductor imaging member with a series of color separation light images wherein the focal plane of the projection images may change from one color separation to another to cause an out-of-focus condition at the photoconductor imaging member tending to adversely affect color balance, the intensity of the exposure being adjustable; and controller means for compensating for differences in focus between the color separations by adjusting at least one of the charge (1) primary voltage on the photoconductor imaging member and (2) the exposure intensity from one color separation to another to improve color balance.

* * * * *